US005366187A

United States Patent [19]

Ishihara

[11] Patent Number: 5,366,187

[45] Date of Patent: Nov. 22, 1994

[54] MULTI-POSITION POWER CORD HOLDING DEVICE

[76] Inventor: Naoki Ishihara, Hilltop Apartment B-18, 60 Cloud View Road, Hong Kong, Hong Kong

[21] Appl. No.: 52,503

[22] Filed: Apr. 26, 1993

[51] Int. Cl.[5] ..... H01R 13/56

[52] U.S. Cl. ..... 248/52; 248/70; 439/446

[58] Field of Search ..... 248/51, 52, 70; 191/124, 125; 439/446, 456, 449, 501

[56] References Cited

U.S. PATENT DOCUMENTS

| | | | |
|---|---|---|---|
| 1,961,013 | 5/1934 | Saraceno | 439/446 |
| 2,530,540 | 11/1950 | Reichold et al. | 439/446 X |
| 4,427,170 | 1/1984 | Truninger | 248/51 |
| 4,517,757 | 5/1985 | Asada et al. | 191/12.4 X |
| 4,585,194 | 4/1986 | Schwob | 248/52 |
| 4,890,713 | 1/1990 | Pagano | 248/51 X |

FOREIGN PATENT DOCUMENTS

| | | | |
|---|---|---|---|
| 331835 | 1/1921 | Germany | 439/446 |

*Primary Examiner*—Ramon O. Ramirez
*Assistant Examiner*—Derek J. Berger
*Attorney, Agent, or Firm*—Moonray Kojima

[57] ABSTRACT

A device for use in appliances wherein a power cord can be easily moved from a position on one side of the appliance to a position on the other side thereof. In one embodiment, a wheel like assembly is used to hold the cord from the outside and has a stopper which can be held by a detent means in a desire one side position and another stopper which can be held by another detent means; in a desired position on the other side so that the cord can be held one one side or the other, and wherein the one stopper can be readily moved out from the one detent means and the other stopper moved to the other detent means by simply moving the cord from one side to the other. The wheel like assembly has walls that suitably align the assembly within a holder arrangement.

2 Claims, 4 Drawing Sheets

MULTI-POSITION POWER CORD HOLDING DEVICE

BACKGROUND OF THE INVENTION

1. Field of Invention

This invention relates to a device for holding an electrical power cord; and more particularly, to such a device for holding the cord in different positions vis-a-vis an appliance in which such device is used.

2. Description of the Prior Art

Some electrical appliances require a power cord to be located in a particular place so that the appliance can be disposed in a particular orientation. For example, a hand held food mixer has its power cord located on a side so that the mixer blades can be placed substantially vertically when the mixer is not in use.

But, disadvantageously, placing the cord on one side (such as the right side) makes it difficult for a left handed person (or a right handed person if the cord is placed on the left to operate the mixer without the power cord interfering with the operation of the mixer.

SUMMARY OF THE INVENTION

Accordingly, an object of the invention is to overcome the foregoing and other deficiencies and disadvantages of the prior art.

Another object is to provide a power cord holder device which enables one to move the power cord to a desired side of the appliance.

A further object is to provide a power cord holder device which is capable of holding a large capacity cord.

A still further object is to increase the attactiveness of appliances by utilizing a power cord holder device which has a unique "high-tech" appearance.

The foregoing and other objects are attained in the invention which encompasses a power cord holder device comprising a movable means for attaching a power cord thereto, means for locking the movable means in a plurality of positions, and base means for anchoring the device in an electrical appliance to be powered by the power cord. The movable means can be moved to be locked into any of the plurality of positions so that the cord attached thereto, for example, can be placed on one side of the appliance or the other. In one embodiment, the movable means is a wheel shaped assembly which holds the cord in a guide disposed therein and exits the wires of the cord from a center thereof. The wheel assembly can be turned by moving the cord , for example, from one side to the other side. The wheel assembly has a pair of stoppers on a face thereof which are engagable with detents on the locking means so that when the cord is moved to one side, one stopper engages one detent means, and when the cord is moved to the other side, the one stopper is disengaged from the one detent means and the other stopper is engaged with the other detent means. In another embodiment, a collar is provided on the cord, and a pair of clip means are provided so that by moving the cord from one side to the other, the collar is engaged in one clip means, then disengaged from that one clip means and engaged with the other clip means.

DETAILED DESCRIPTION OF THE PREFERRED EMBODIMENTS

Figure 1:
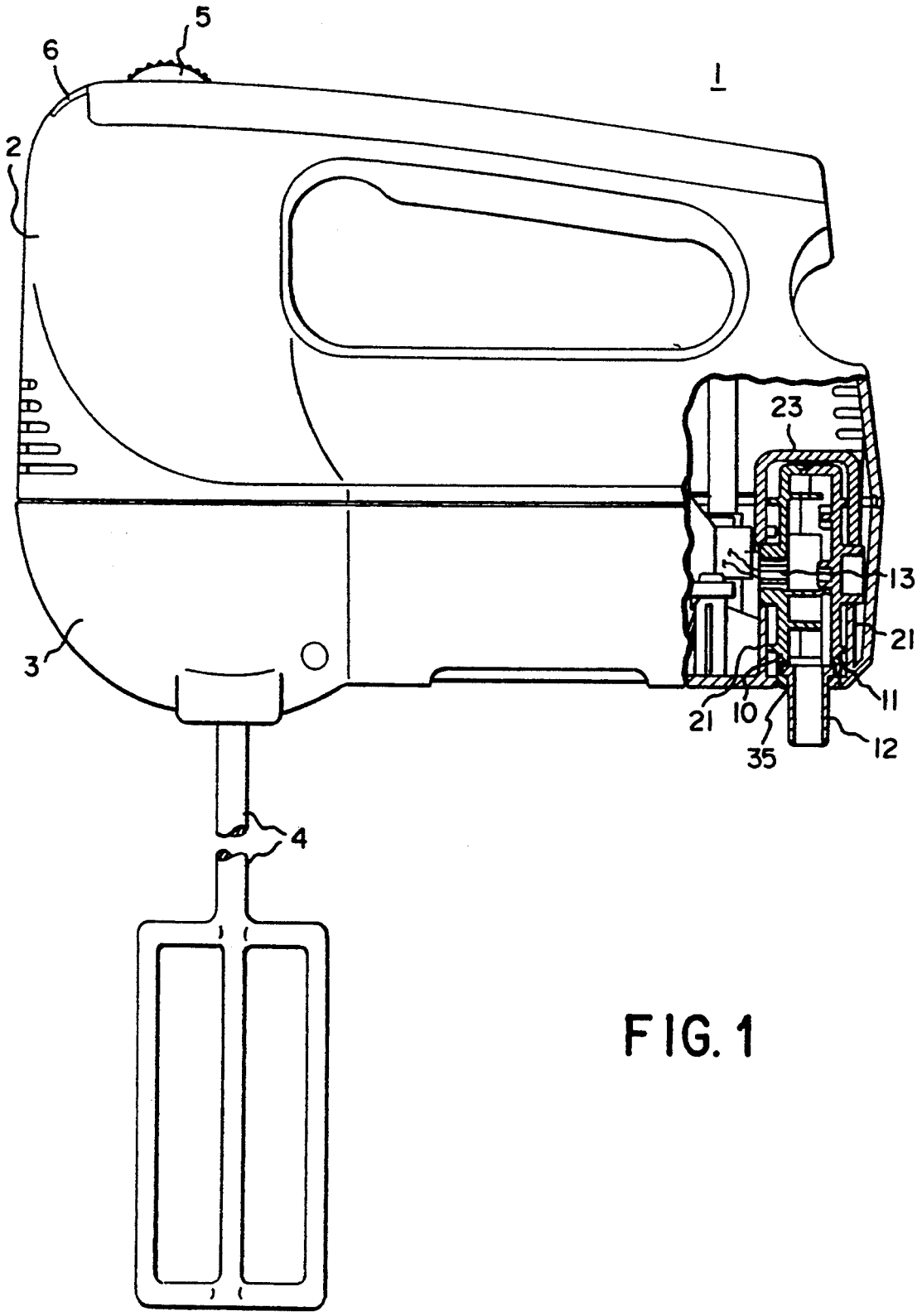
FIG. 1 is a right side view depicting a hand held mixer with a cutaway portion showing an illustrative embodiment of the invention used therein.
Figure 2:
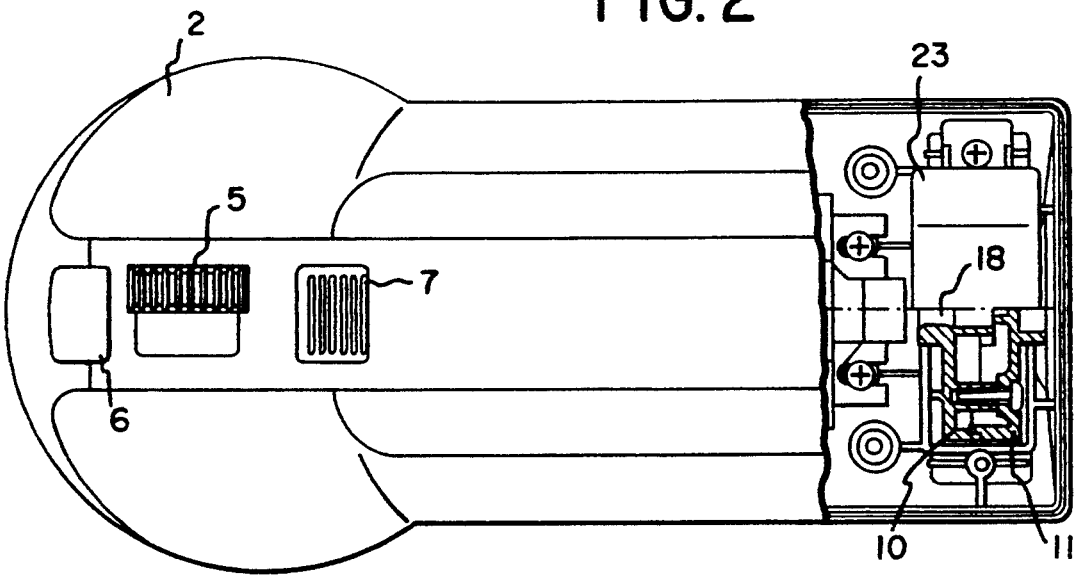
FIG. 2 is a top view of the mixer with a partial cutaway portion depicting a top view of the illustrative embodiment.
Figure 3:
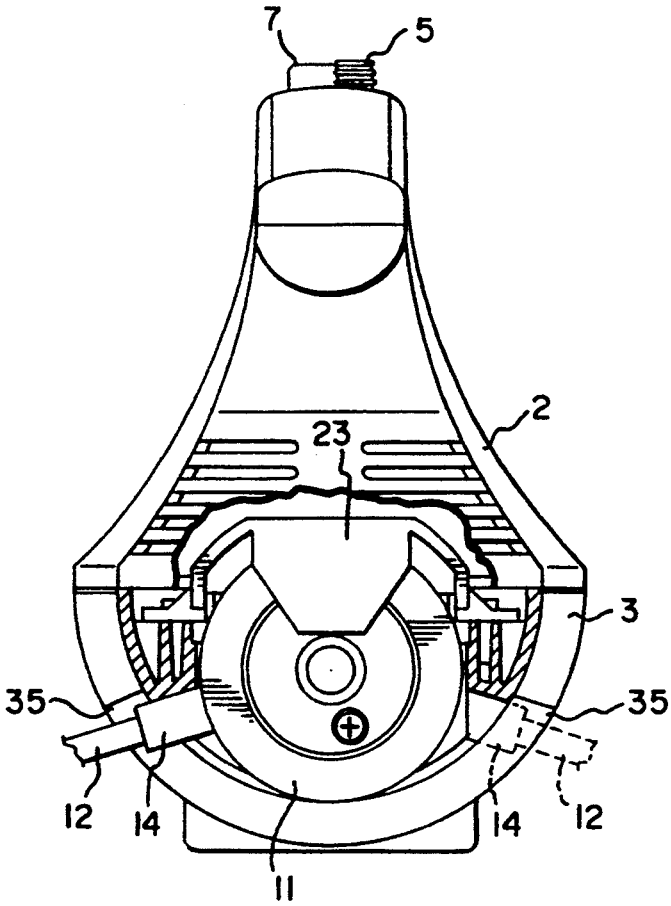
FIG. 3 is a rear end view having a partial cutaway portion depicting the illustrative embodiment.

Turning now to FIGS. 1, 2, 3, there are depicted a hand held mixer 1 comprising an upper casing 2, and connected, by screws, not shown, thereto a lower casing 3, and holding a pair of mixer blades 4 (only one is shown for sake of convenience). Shown at the top of upper casing 2 are an eject button 6 for ejecting the blades 4, a power ON/OFF switch 7 (see FIGS. 2, 3) and a variable speed wheel control 5. In these drawings, the left side is the front of the mixer 1, the right is the rear end of mixer 1, and the handle portion is the top, and the part whereat the blades 4 are inserted is the bottom. As depicted by means of a partial cutaway view, at the rear bottom part of mixer 1, there are disposed a power cord 12, held by cord holder wheel assembly 8 (see FIG. 4) comprising a front wheel 10 and a rear wheel 11, which are held together by means of screws of friction snap-on means. The wheel assembly 8 is held within lower wheel holder 21 and upper cover 23 (see also FIG. 6). The cord 12, as will be explained in greater detailed hereinbelow, is held by wheel assembly 8 and its wires exited through a center hole 13 of the front wheel 10 (see FIG. 4).

The embodiment uses a feature which is not available in conventional appliances, that is a mechanism for allowing the cord 12 to be semi-permanently fixed to one side of the appliance or the other side. In FIG. 3, cord 12 can be readily fixed in and then moved from a left position (such as would be desired by a left handed operator) to a right position (such as would be desired by a right handed operator) through cord opening 35 in lower casing 3 (see also FIG. 1).

Figure 7:
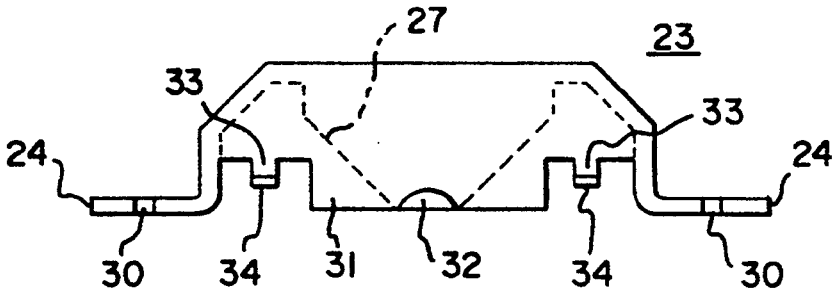
FIG. 7 is a front view of the upper cover.

The wheel assembly 8,comprising front wheel 10 and rear wheel 11, has a pair of stoppers 18 suitably placed on the front surface of the front wheel 10 so that when the cord is moved to the left position (in FIG. 3), one of the stoppers 18 (see FIG. 4) will be held by one of the detent means 34 formed as part of upper cover 23 (see FIG. 7). The upper cover 23 applies sufficient pressure to hold wheel assembly 8 in a desired rotatable position therein, and when the cord 12 is desired to be moved, with human pressure, the one stopper 18 will be moved out from the one detent means, and the cord 12 will be moved to the other position whereat the other stopper 18 on the other side will be held by the other detent means 34 on the other side of upper cover 23.

Advantageously, the appearance of the mixer is commercially improved by use of the swingable cord emanating from the cord opening 35. The appearance is that of a "high-tech" application. Also, advantageously, the cord can be of larger diameters, such as useful in higher wattage appliances. The invention provides a transition means whereby the large diameter cord is held by the wheel assembly securely and only the wires thereof are exited from the center hole 13(see FIG. 4).

Figure 4:
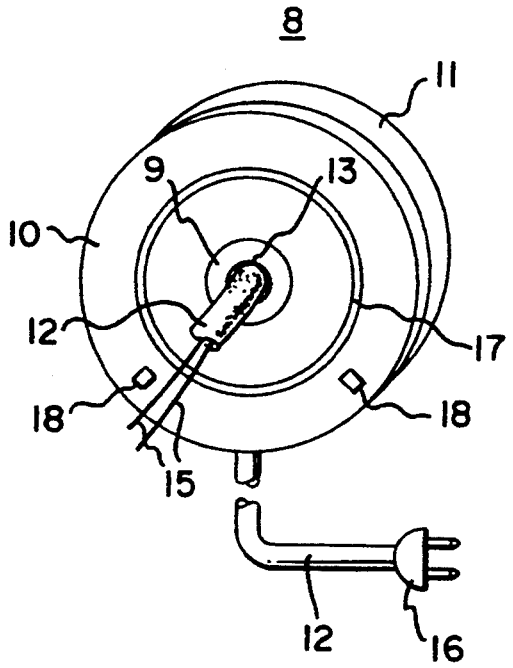
FIG. 4 is a perspective view depicting the cord holder wheel assembly of the invention.
Figure 6:
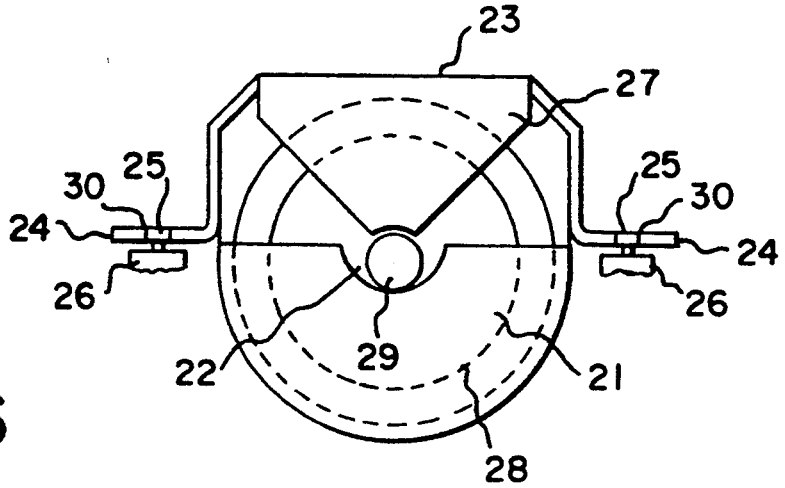
FIG. 6 is a rear view depicting the wheel assembly held within a lower cord wheel holder and an upper cover.

Turning now to FIG. 4, wheel assembly 8 is depicted as comprising front wheel 10 attached to rear wheel 11, such as by screws or by snap-on fitting. The front wheel 10 comprises a center hole 13 through which power cord 12 is inserted and the wires thereof exited from inside the wheel assembly 8. The wires 15 being so exited are connected with the desired terminals inside of mixer 1. The front wheel 10 also comprises a center cylindrical axle 9 surrounding center hole 13, and an alignment wall 17. The center cylindrical axle 9 , as will be seen, is rotatively held by lower wheel holder 21 and upper cover 23 (FIG. 6). The alignment wall 17 is of suitable dimensions to enable the wheel assembly 8 to rotate within the lower wheel holder 21 and upper cover 23 when cord 12 is desired to be moved from the left to right or right to left (as shown in FIG. 3). Front wheel 10 also has a pair of stoppers 18, one being used to hold the cord in one position, and the other stopper being used to hold the cord in another position. The stopper 18 is held detent means 34 of upper cover 23.

In FIG. 1, the detent means 34 is depicted as being just above the center cylindrical axle 9, between the front wall of upper cover 23 and the front face of front wheel 10. When the front wheel 10 is rotated, the stopper 18 on one side will engage with one detent 34 and be in a fixed position so that cord 12 will be on one side of mixer 1. The stopper 18 is not depicted in FIG. 1 for sake of convenience. But, it can be readily seen that the stopper 18 located on the front frace of front wheel 10, when cord 12 is moved from the left position to the right position (see FIG. 3) will engage one detent 34 at the point shown in FIG. 1. In such a case, the stoppers 18 are located on the front face of front wheel 10 about 90° from each other on the same diameter. Of course, other angular placements can be used depending on where the cord is to be fixed vis-a-vis the mixer. Cord 12 has plug 16 which can be used to plug into household current.

Figure 5:
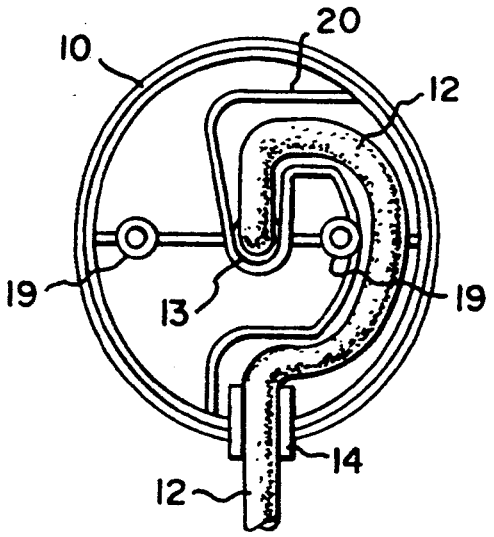
FIG. 5 is an inside view of the front wheel of the wheel assembly of the invention.

Turning now to FIG. 5, depicted is the inside of front wheel 10, comprising a guide wall 20, made in such a manner as to hold securely cord 12, which has collar 14, so as to hold the cord securely within wheel assembly 8 and to make same substantially waterproof. The guide wall 20 also serves to hold the cord 12, when, for example,it is pulled by a human operator, so that the cord 12 cannot be pulled out from the appliance. Also,in the inside.,are holes 19 so that screws can be used to hold rear wheel 11 and front wheel 10 securely together. Of course, we can also secure the two together by other means , such as by snap-fitting.

FIG. 6 depicts the wheel assembly 8 being rotatively held by lower wheel holder 21 and upper cover 23. The lower wheel holder 21 may be part of the lower casing 2 and be molded together therewith, or be separate therefrom and be connected thereto as desired. The upper cover 23 is attached to the body 26 of lower casing 3 by screws 25 through holes 30 in wings 24 of upper cover 23. On the rear part of upper cover 23, there is provided a rear axle holder 27. The real wheel 11 comprises a rear cylindrical axle 29, which is disposed in and held by circular hole 22 of the lower wheel holder 21, and an alignment wall 28, which is of suitable dimensions to enable the wheel assembly 8 to be rotatably held securely within the upper cover 23 and lower wheel holder 21. The alignment wall 28 of rear wheel 11 is similar to the alignment wall 17 of front wheel 10, and the rear cylindrical axle 29 of rear wheel 11 is similar to the front cylindrical axle 9 of front wheel 10. It should be mentioned that the inside of rear wheel 11 is plain and does not contain guide walls, although such guide walls (similar to guide wall 20 of front wheel 10) can be used. The rear wheel provides a cap for the front wheel , and provides the alignment walls and cylindrical axle for the suitable fitting and holding of the wheel assembly in the lower wheel holder 21 and upper cover 23.

Turning now to FIG. 7, the upper cover 23 comprises the just described wings 24, holes 30 for insertion of screws to hold the upper cover to lower holder 21, and rear axle holder 27. In addition, the upper cover 23 comprises a front axle holder 31, opening 32 disposed within front axle hodler 31 for holding the front cylindrical axle 9 of front wheel 10, and a pair of extensions 33 at the end of which are located detent means 34. The extensions are of suitable dimensions so that the stoppers 18 will be stopped and held at desired positions and cord 12 will be located at the desired side of the mixer. With stoppers 18 being at about the locations shown in FIG. 4,i.e. about 90° apart, with the cord 12 at the bottom of wheel assembly 8, the detent means 34 should be located on either side of the front cylindrical axle 9 and just above such front cylindrical axle 9, as shown in FIG. 1. In that manner, the swing of the cord 12 through opening 35 in lower casing 3, from the left position to the right position, in FIG. 3, can be accomplished with one stopper 18 being held first by one detent means 34 on one side, and then the other stopper 18 being held by the other detent means 34 on the other side. In this manner, advantageously, the cord 12 can be readily, and semi-permanently, moved from a position on one side of the mixer, to the other, with simplicity and ease. Thus, the inventor has substantially advanced the art.

Figure 8:
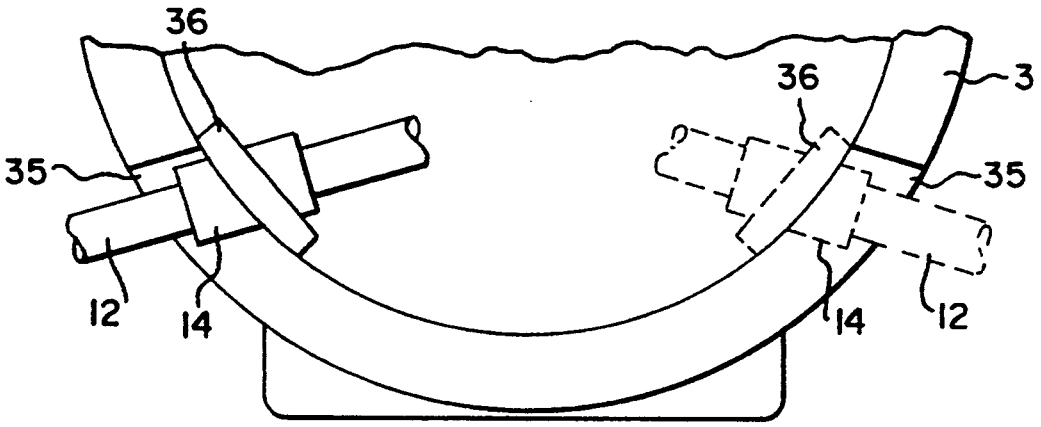
FIG. 8 is a partial end view depicting an alternative embodiment of the invention.

There are other ways which might be used to hold the cord 12 in the left side or the right side. An alternative embodiment is shown in FIG. 8, wherein a cord collar 14 is held at the left side or the right side by means of a left clip holder 36 or a right clip holder 36. The clip holders 36 operate by means of friction to hold collar 14 after collar 14 is pushed into the clip means when cord 12 is moved from one position to the other through cord opening 35 by a human operator. On the other end of cord 12, inside the mixer, a means (not shown) is provided to close hole 35 so that the wires 15 in cord 12 will not be exposed to water or other external elements. FIG. 8 is similar to the lower part of FIG. 3 and shows only the important alternative elements, for sake of convenience.

Advantageously, all off the parts shown and described herein may be manufactured of plastic so that simple molding techniques can be used and enable costs to be effectively controlled. Also, by use of unique attractive molds, the entire mixer can be made which is attactive to the consumer.

The foregoing description is illustrative of the principles of the invention. Numerous extensions and modifications thereof would be apparent to the worker skilled in the art. All such extensions and modifications are to be considered to be within the spirit and scope of the invention.

What is claimed is:

1. A cord holder device for use in an appliance comprising a body, said cord holder device enabling an operator to move a power cord from one side of the appliance to another side of the appliance, said cord holder device comprising first means for holding said power cord, said first means being positionable in and movable between a first position and a second position; and second means for releasably holding said first means in each of said first and second positions;

said first means comprising a wheel shaped assembly for holding said power cord therein, said wheel shaped assembly comprising a face having a pair of stopper means thereon;

said second means comprising detent means for holding one of said pair of stopper means when said first means is in said first position, and for holding the other of said pair of stopper means when said first means is in said second position;

said wheel shaped assembly comprising a first wheel, a second wheel, and means for connecting together said first wheel and said second wheel, said first wheel comprising an inner side wherein a guide well is provided for threading and holding securely said power cord, said first wheel also having a center hole for exiting of said power cord, and said first wheel also comprising said face with said pair of stopper means disposed on an outer side thereof; and wherein said second means comprises a holder means for said wheel shaped assembly; and wherein said first wheel and said second wheel each comprises and alignment wall and a center cylindrical axle, said cylindrical axle of each of said first and second wheels being used to rotatably hold said wheel shaped assembly in said holder means, and said alignment wall of each of said first and second wheels being used to align said wheel shaped assembly within said holder means, and to prevent external elements from entering said appliance.

2. The device of claim 1, wherein said second means further comprises a cover and wherein said wheel shaped assembly is held rotatively in said holder means and covered by said cover.

* * * * *